US011541272B2

(12) United States Patent
Tsai

(10) Patent No.: US 11,541,272 B2
(45) Date of Patent: Jan. 3, 2023

(54) FOLDABLE TREADMILL WITH FURNITURE CONFIGURATION

(71) Applicant: Yu-Lun Tsai, Taichung (TW)

(72) Inventor: Yu-Lun Tsai, Taichung (TW)

( * ) Notice: Subject to any disclaimer, the term of this patent is extended or adjusted under 35 U.S.C. 154(b) by 172 days.

(21) Appl. No.: 17/079,794

(22) Filed: Oct. 26, 2020

(65) Prior Publication Data

US 2022/0126165 A1 Apr. 28, 2022

(51) Int. Cl.
*A63B 22/02* (2006.01)

(52) U.S. Cl.
CPC ..... *A63B 22/02* (2013.01); *A63B 2210/06* (2013.01); *A63B 2210/50* (2013.01); *A63B 2210/54* (2013.01); *A63B 2210/56* (2013.01); *A63B 2210/58* (2013.01); *A63B 2225/093* (2013.01)

(58) Field of Classification Search
CPC ..... A63B 71/0036; A63B 71/0619; A63B 22/0002; A63B 22/02; A63B 22/0664; A63B 22/0056; A63B 22/0046; A63B 22/0076; A63B 22/0207; A63B 22/0214; A63B 22/0221; A63B 22/0228; A63B 22/0235; A63B 22/0242; A63B 22/025; A63B 22/0257; A63B 22/0264; A63B 2210/50; A63B 2210/04; A63B 2210/58; A63B 69/18; A63B 21/4035; A63B 21/0605; A63B 60/56; A63B 60/38; A47C 7/628; A47C 9/002; A47C 19/22; A47C 19/00; B65D 43/18; B65D 43/16; A47B 49/00; A47B 49/04; A47B 49/81
USPC ..... 482/52, 148
See application file for complete search history.

(56) References Cited

U.S. PATENT DOCUMENTS 1,336,774 A * 4/1920 Cooper ..... A63B 22/0605 482/57
1,365,460 A * 1/1921 Cooper ..... A61H 33/06 4/532
2,632,645 A * 3/1953 Barkschat ..... A63B 21/0628 482/41
3,650,529 A * 3/1972 Salm ..... A63B 22/02 482/54
3,731,917 A * 5/1973 Townsend ..... A63B 22/02 482/4
3,738,649 A * 6/1973 Miller ..... A63B 21/04 482/130

(Continued)

*Primary Examiner* — Megan Anderson
*Assistant Examiner* — Thao N Do
(74) *Attorney, Agent, or Firm* — Alan D. Kamrath; Karin L. Williams; Mayer & Williams PC

(57) ABSTRACT

A foldable treadmill includes a working base, a cover pivotally connected with the working base, a walking belt mounted on the working base, at least two rollers arranged in the walking belt, a support board arranged in the walking belt, two handle units mounted on the working base, and a front support rack mounted on the cover. The working base has two first receiving grooves. The cover has a second receiving groove. The two handle units are removably received in the two first receiving grooves of the working base respectively. Each of the two handle units includes an upright pivotally connected with the working base, and a first handle pivotally connected with the upright. The front support rack is pivotally connected with the cover and received in the second receiving groove of the cover.

4 Claims, 9 Drawing Sheets

(56) References Cited

U.S. PATENT DOCUMENTS 3,874,657 A * 4/1975 Niebojewski ..... A63B 21/16 482/142
4,344,660 A * 8/1982 Molnar ..... A63B 71/0045 312/324
4,431,181 A * 2/1984 Baswell ..... A63B 21/4043 482/102
5,711,745 A * 1/1998 Yang ..... A63B 22/02 482/54
5,746,682 A * 5/1998 Hung ..... A63B 22/02 482/54
5,782,723 A * 7/1998 Kuo ..... A63B 22/02 482/54
5,788,611 A * 8/1998 Kuo ..... A63B 22/02 402/54
5,813,947 A * 9/1998 Densmore ..... A63B 22/02 482/52
6,224,516 B1 * 5/2001 Disch ..... A63B 22/02 482/54
6,520,890 B2 * 2/2003 Hsu ..... A63B 22/02 482/54
7,614,991 B2 * 11/2009 Fox ..... A63B 22/0235 482/52
9,776,039 B1 * 10/2017 Xu ..... A63B 71/0622
10,434,355 B1 * 10/2019 Kipnis ..... A63B 21/4031
10,561,894 B2 * 2/2020 Dalebout ..... A63B 22/0235
2002/0043909 A1 * 4/2002 Nielsen ..... A47B 85/08 312/237
2002/0055421 A1 * 5/2002 Kiiski ..... A63B 22/0235 482/54
2004/0192515 A1 * 9/2004 Cane' ..... A63B 69/0035 482/54
2007/0015634 A1 * 1/2007 Ho ..... A63B 22/02 482/54
2008/0058169 A1 * 3/2008 Fox ..... A63B 71/0054 482/54
2009/0005224 A1 * 1/2009 Davis ..... A63B 22/0257 482/54
2009/0163326 A1 * 6/2009 Wang ..... A63B 22/02 482/54
2011/0111936 A1 * 5/2011 Shabodyash ..... A63B 21/1609 482/142
2013/0157811 A1 * 6/2013 Shabodyash ..... A63B 22/02 482/51
2013/0231228 A1 * 9/2013 Wyatt ..... A63B 21/0442 482/130
2015/0051051 A1 * 2/2015 Liu ..... A63B 22/02 482/54
2015/0087483 A1 * 3/2015 Liu ..... A63B 22/02 482/54
2016/0074698 A1 * 3/2016 Figueroa ..... A47C 17/38 5/2.1
2016/0346598 A1 * 12/2016 Manzke ..... A63B 22/0023
2017/0120102 A1 * 5/2017 Chen ..... A63B 22/02
2019/0166993 A1 * 6/2019 Siaperas ..... A47B 81/00
2020/0047021 A1 * 2/2020 Tsai ..... A63B 71/0036
2020/0047022 A1 * 2/2020 Tsai ..... A63B 22/0076
2020/0047024 A1 * 2/2020 Tsai ..... A63B 22/0694
2020/0047050 A1 * 2/2020 Tsai ..... A63B 22/0664
2021/0106899 A1 * 4/2021 Willardson ..... A63B 22/0605
2021/0113885 A1 * 4/2021 Maresh ..... A63B 1/00

* cited by examiner

FOLDABLE TREADMILL WITH FURNITURE CONFIGURATION

BACKGROUND OF THE INVENTION

1. Field of the Invention

The present invention relates to an exercising apparatus and, more particularly, to a foldable treadmill.

2. Description of the Related Art

A conventional treadmill comprises a platform, a walking belt mounted on the platform, two rollers arranged in the walking belt, a support board arranged in the walking belt, and a handle mounted on the platform. However, the conventional treadmill has a large volume and cannot be folded, thereby causing inconvenience to the user in storage and transportation. In addition, the conventional treadmill does not have a configuration mating with the interior of the house, thereby decreasing the aesthetic quality of the house. Further, the conventional treadmill does not have a dust-proof function so that dirt is easily accumulated on the conventional treadmill.

BRIEF SUMMARY OF THE INVENTION

The primary objective of the present invention is to provide a foldable treadmill with a furniture configuration.

In accordance with the present invention, there is provided a foldable treadmill comprising a working base, a cover pivotally connected with the working base, a walking belt mounted on the working base, at least two rollers arranged in the walking belt, a support board arranged in the walking belt, two handle units mounted on the working base, and a front support rack mounted on the cover. The working base is a platform placed on a plane. The working base has a top provided with two first receiving grooves. The cover has a side pivotally connected with a side of the working base. The cover is pivotable relative to the working base to open or cover the top of the working base. The cover has an inner face provided with a second receiving groove. The walking belt is rotatably mounted on the working base. The two handle units are removably received in the two first receiving grooves of the working base respectively. Each of the two handle units includes an upright pivotally connected with the working base, and a first handle pivotally connected with the upright. Each of the two handle units is movable relative to the working base. The first handle is movable relative to the upright. The front support rack is pivotally connected with the cover and received in the second receiving groove of the cover. The front support rack is movable relative to the working base.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
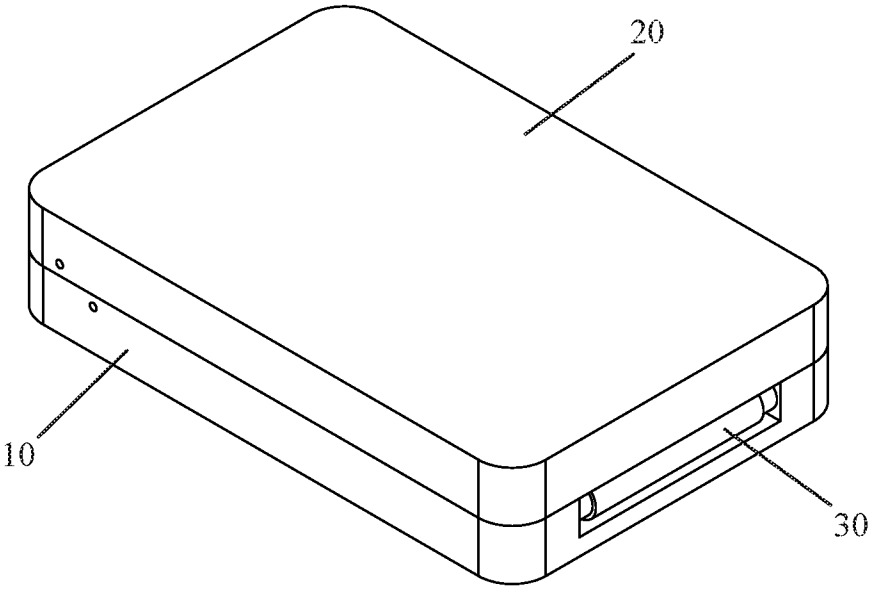
FIG. 1 is a perspective view of a foldable treadmill in accordance with the first preferred embodiment of the present invention.

Referring to the drawings and initially to FIGS. 1-5, a foldable treadmill in accordance with the preferred embodiment of the present invention comprises a working base 10, a cover 20 pivotally connected with the working base 10, a walking belt 30 mounted on the working base 10, at least two rollers 31 arranged in the walking belt 30, a support board 32 arranged in the walking belt 30, two handle units 50 mounted on the working base 10, and a front support rack 60 mounted on the cover 20.

The working base 10 is a platform placed on a plane. The working base 10 has a top provided with two first receiving grooves 11. The two first receiving grooves 11 are arranged at an edge of the working base 10.

The cover 20 has a side pivotally connected with a side of the working base 10. The cover 20 is pivotable relative to the working base 10 to open or cover the top of the working base 10. The cover 20 has an inner face provided with a second receiving groove 21. Thus, when the cover 20 is pivoted upward and removed from the working base 10, the two first receiving grooves 11 and the second receiving groove 21 are exposed outward.

The walking belt 30 has an endless shape. The walking belt 30 is rotatably mounted on the working base 10. The at least two rollers 31 and the support board 32 are encompassed by the walking belt 30. The walking belt 30 is driven by the at least two rollers 31 and moved on the support board 32.

Figure 2:
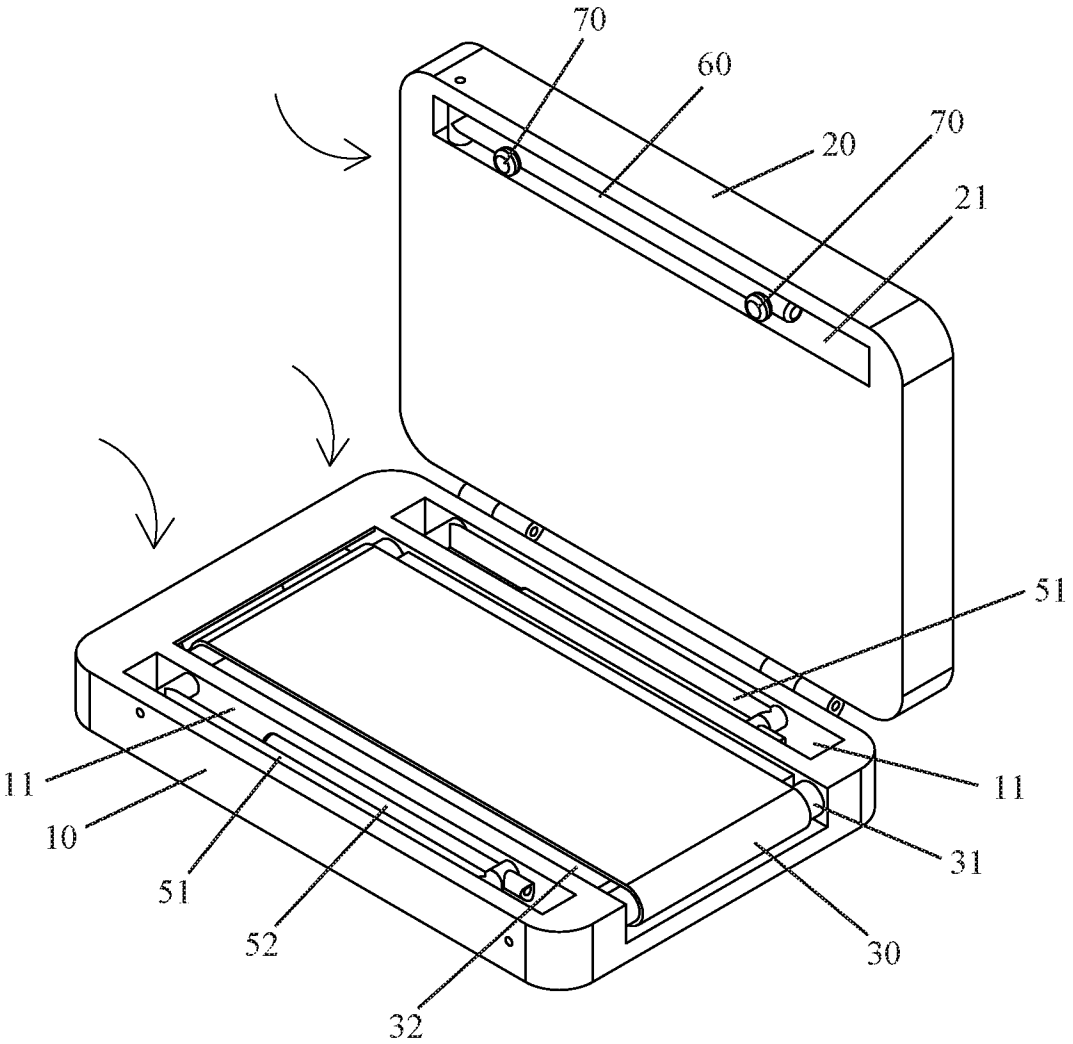
FIG. 2 is a perspective view showing the cover is removed.
Figure 3:
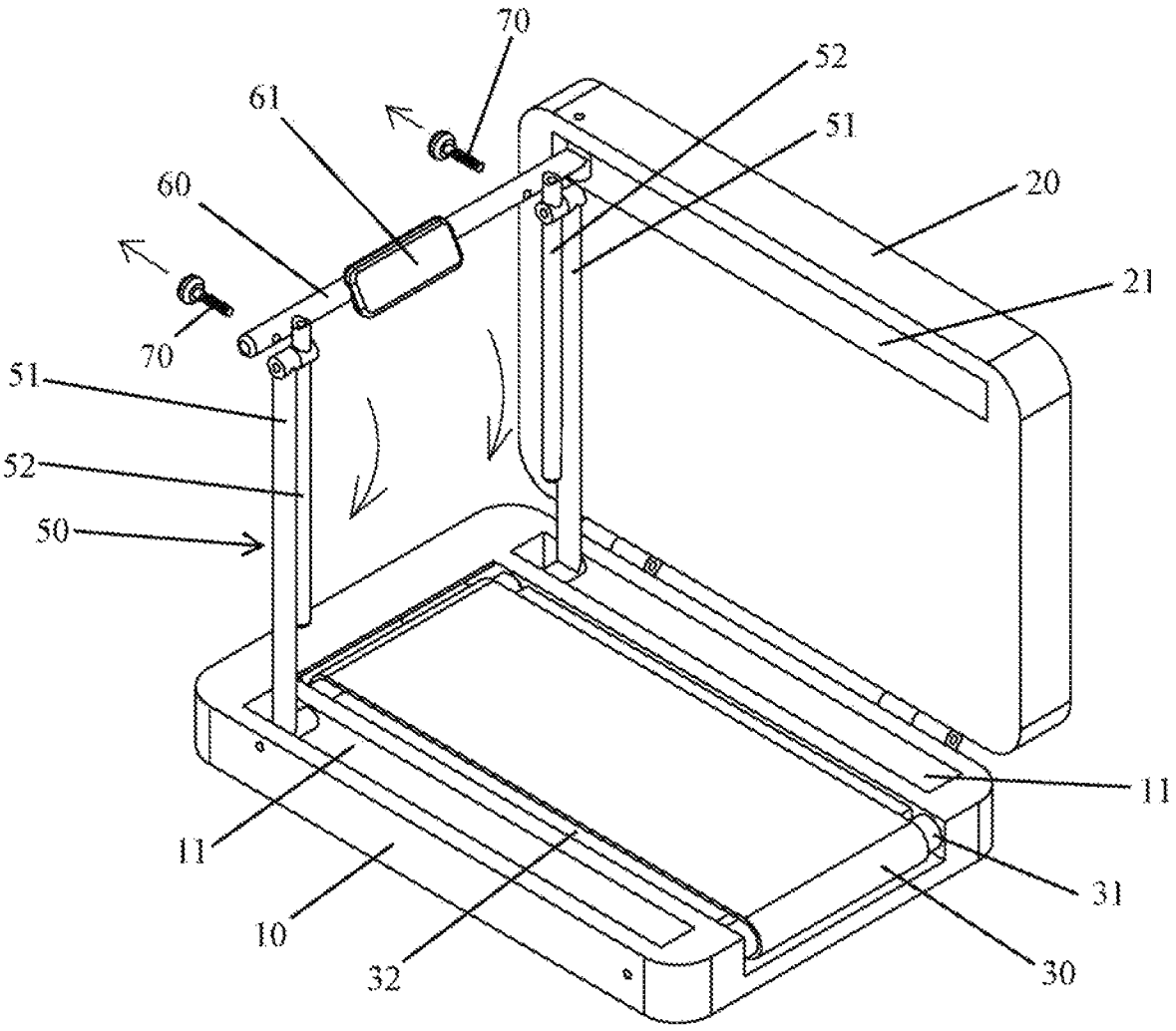
FIG. 3 is a perspective view showing a partially expanded state of the foldable treadmill in accordance with the first preferred embodiment of the present invention.
Figure 4:
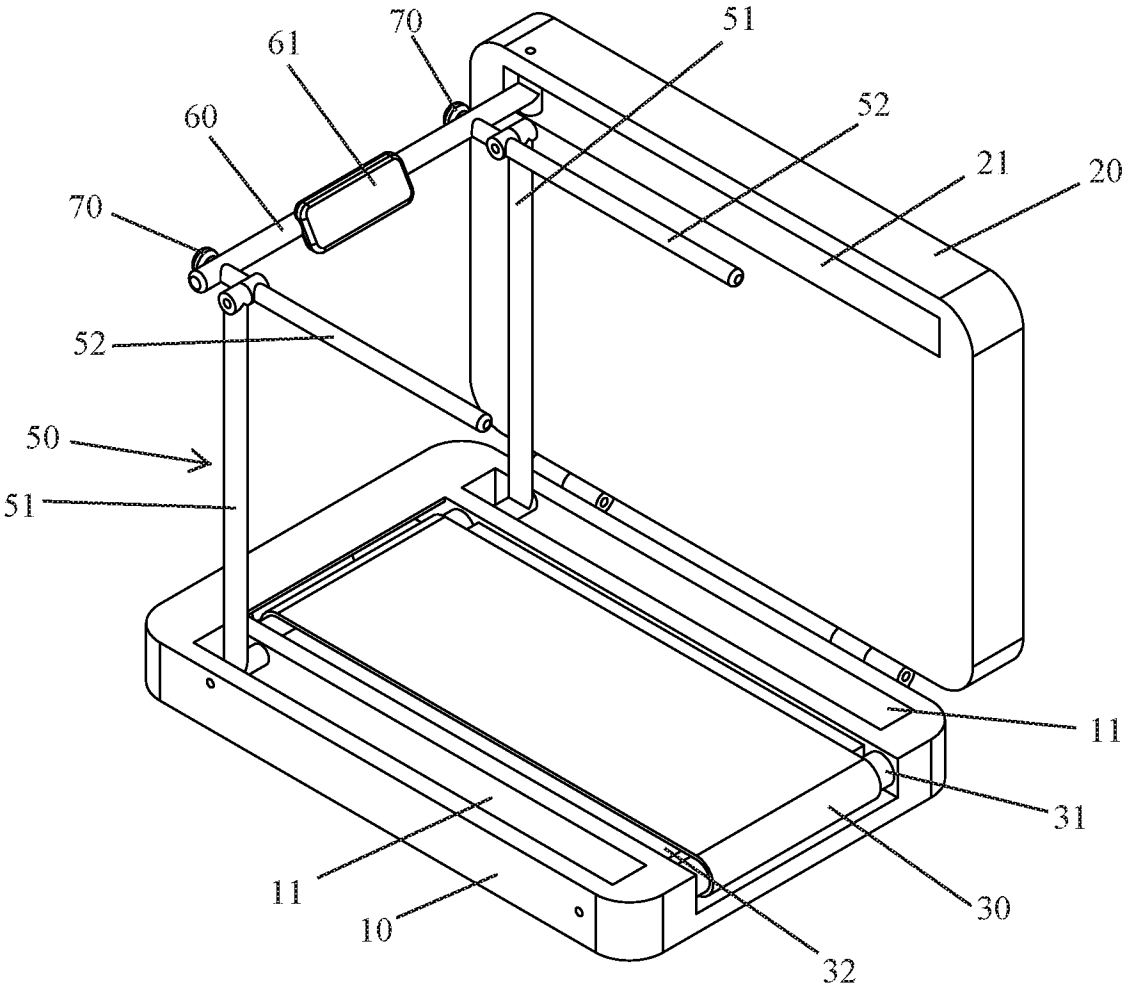
FIG. 4 is a perspective view showing a fully expanded state of the foldable treadmill in accordance with the first preferred embodiment of the present invention.
Figure 5:
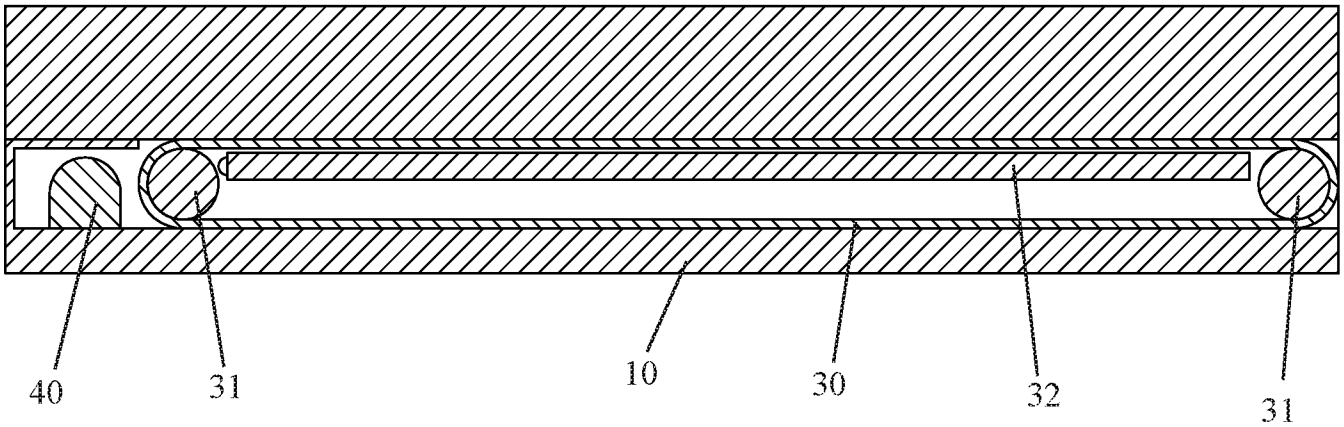
FIG. 5 is a cross-sectional view of the foldable treadmill as shown in FIG. 1.

The two handle units 50 are removably received in the two first receiving grooves 11 of the working base 10 respectively. Each of the two handle units 50 includes an upright 51 pivotally connected with the working base 10, and a first handle 52 pivotally connected with the upright 51. Each of the two handle units 50 is movable relative to the working base 10 between a first position as shown in FIG. 2 where the upright 51 and the first handle 52 are folded into and fully received in one of the two first receiving grooves 11 of the working base 10 and a second position as shown in FIG. 3 where the upright 51 and the first handle 52 are expanded outward from one of the two first receiving grooves 11 of the working base 10. The first handle 52 is movable relative to the upright 51 between a first location as shown in FIG. 3 where the first handle 52 is juxtaposed to the upright 51 and a second location as shown in FIG. 4 where the first handle 52 is perpendicular to the upright 51.

The front support rack 60 is pivotally connected with the cover 20 and received in the second receiving groove 21 of the cover 20. The front support rack 60 is movable relative to the working base 10 between a first position as shown in FIG. 2 where the front support rack 60 is folded into and fully received in the second receiving groove 21 of the cover 20 and a second position as shown in FIG. 3 where the front support rack 60 is expanded outward from the second receiving groove 21 of the cover 20 and is perpendicular to the cover 20.

In the preferred embodiment of the present invention, the front support rack 60 is provided with an electronic instrument (or control panel) 61.

In the preferred embodiment of the present invention, the foldable treadmill further comprises a drive motor 40 mounted on the working base 10. The drive motor 40 drives and rotates the at least two rollers 31 which drives and rotates the walking belt 30.

In the preferred embodiment of the present invention, each of the two handle units 50 is connected with the front support rack 60 by a fastener member 70. Preferably, the fastener member 70 is a screw knob.

In the preferred embodiment of the present invention, the fastener member 70 extends through the front support rack 60 and is screwed into the first handle 52 of each of the two handle units 50.

In operation, after the cover 20 is pivoted upward to open the working base 10, the front support rack 60 is moved outward relative to the working base 10 and is expanded outward from the second receiving groove 21 of the cover 20 until the front support rack 60 is perpendicular to the cover 20. Then, each of the two handle units 50 is pivoted and moved upward relative to the working base 10 such that the upright 51 and the first handle 52 are expanded outward from one of the two first receiving grooves 11 of the working base 10 until the upright 51 is disposed at a vertical state. Then, the first handle 52 is pivoted and moved upward relative to the upright 51 until the first handle 52 is perpendicular to the upright 51. Then, the fastener member 70 extends through the front support rack 60 and is screwed into the first handle 52 of each of the two handle units 50. Thus, the first handle 52 of each of the two handle units 50 and the front support rack 60 are secured by the fastener member 70. In such a manner, when the user is walking or running on the walking belt 30, the front support rack 60 or the first handle 52 of each of the two handle units 50 is used to support the user's hands.

Figure 6:
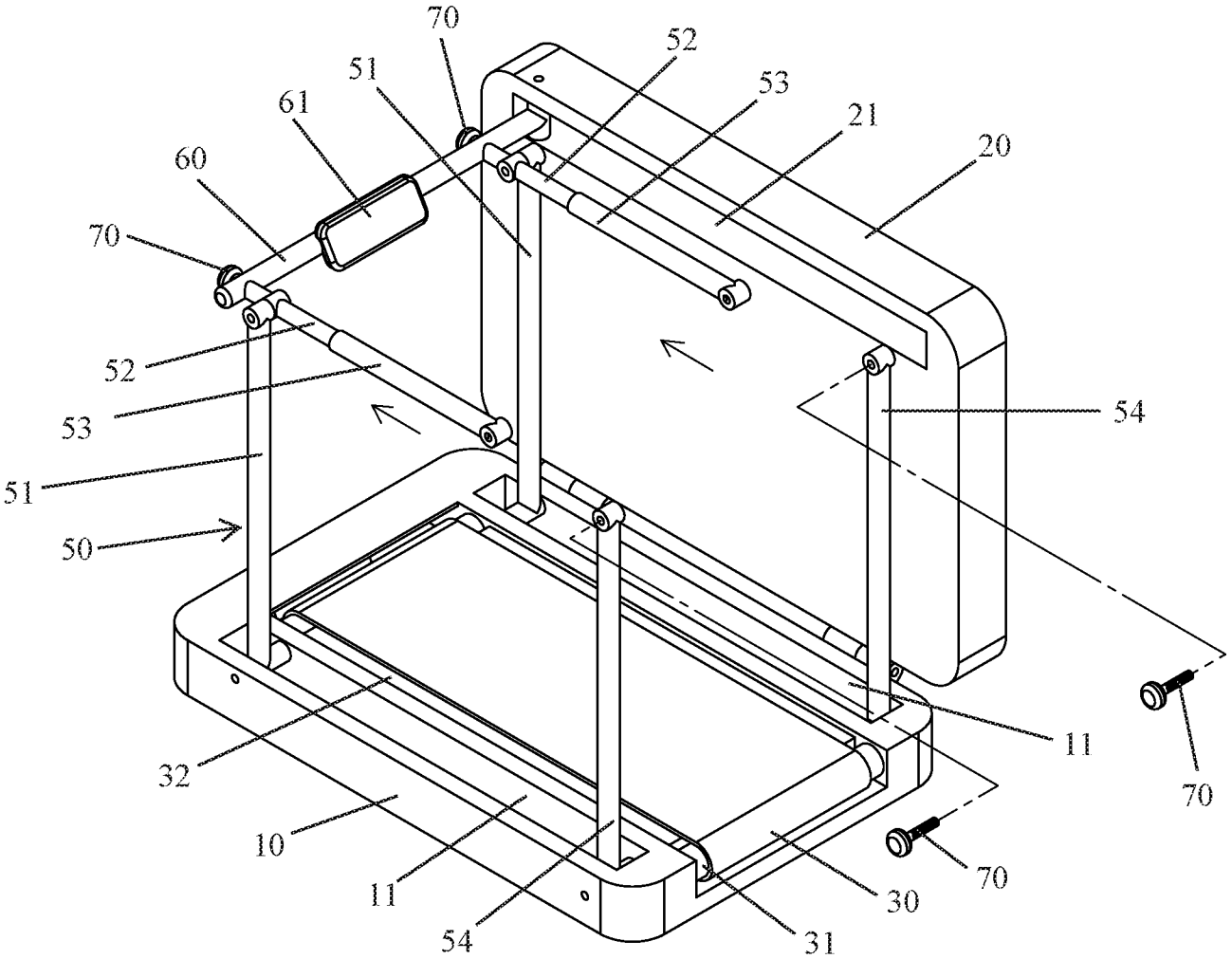
FIG. 6 is a perspective view showing a partially expanded state of a foldable treadmill in accordance with the second preferred embodiment of the present invention.
Figure 7:
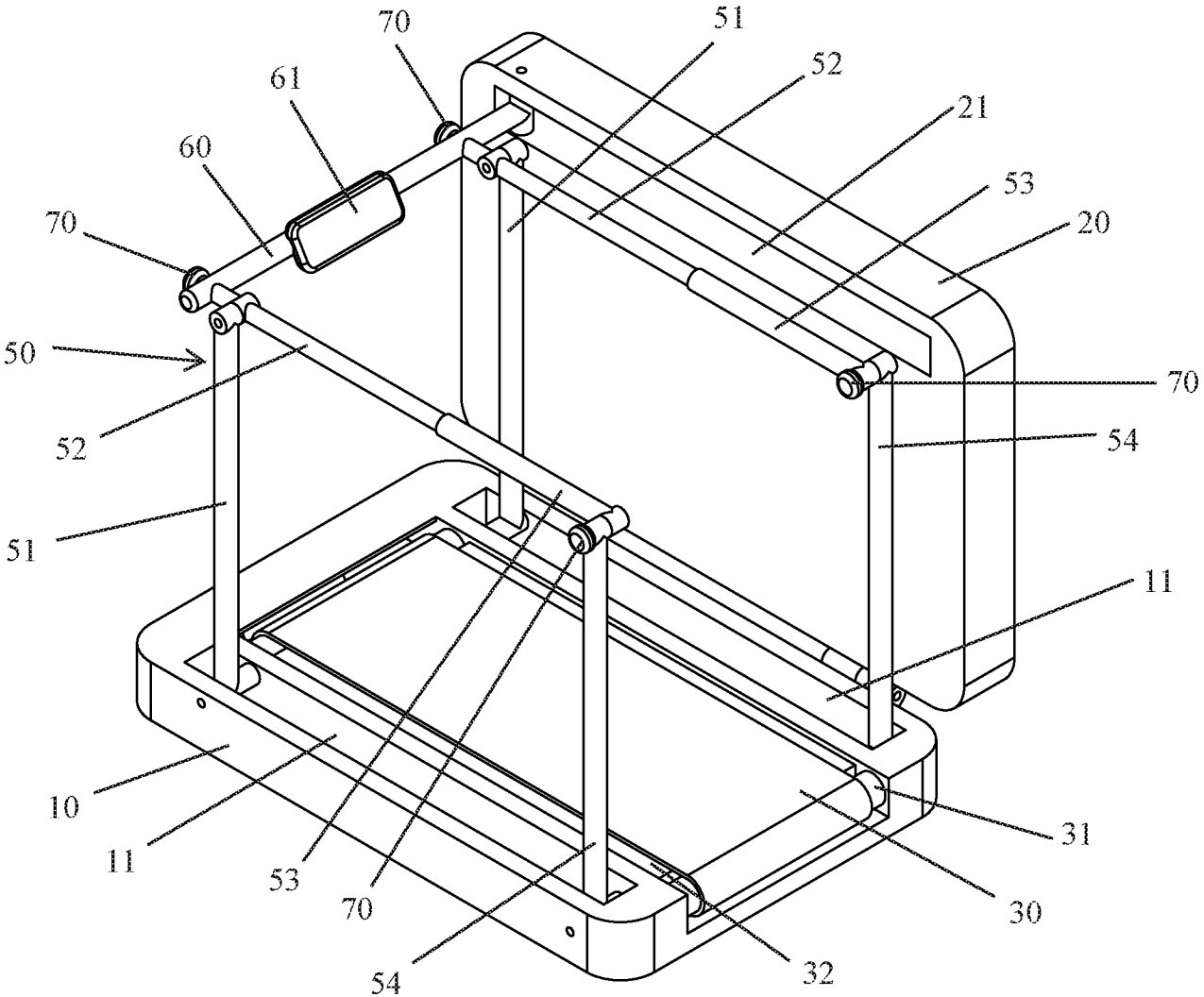
FIG. 7 is a perspective view showing a fully expanded state of the foldable treadmill in accordance with the second preferred embodiment of the present invention.
Figure 8:
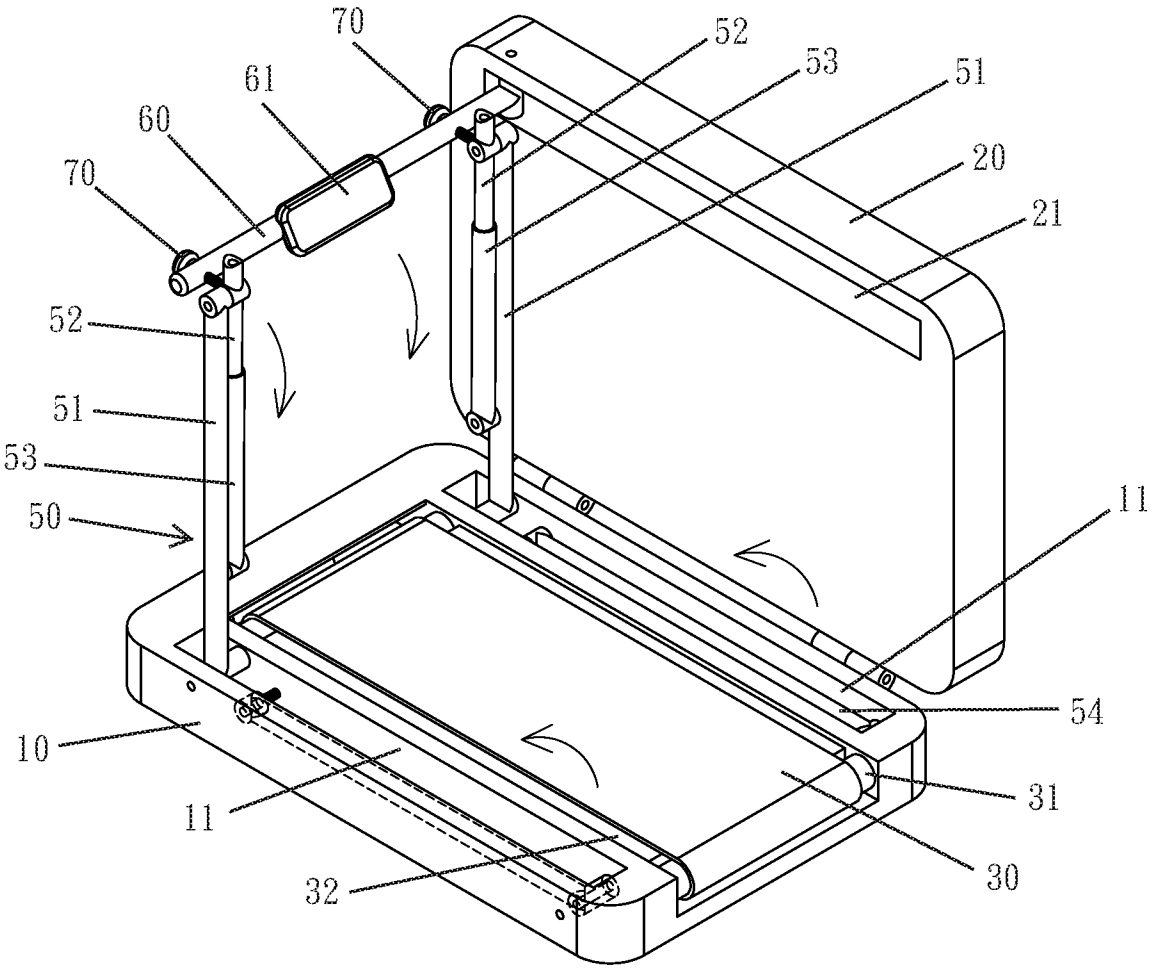
FIG. 8 is a perspective view showing a partially folded state of the foldable treadmill in accordance with the second preferred embodiment of the present invention.
Figure 9:
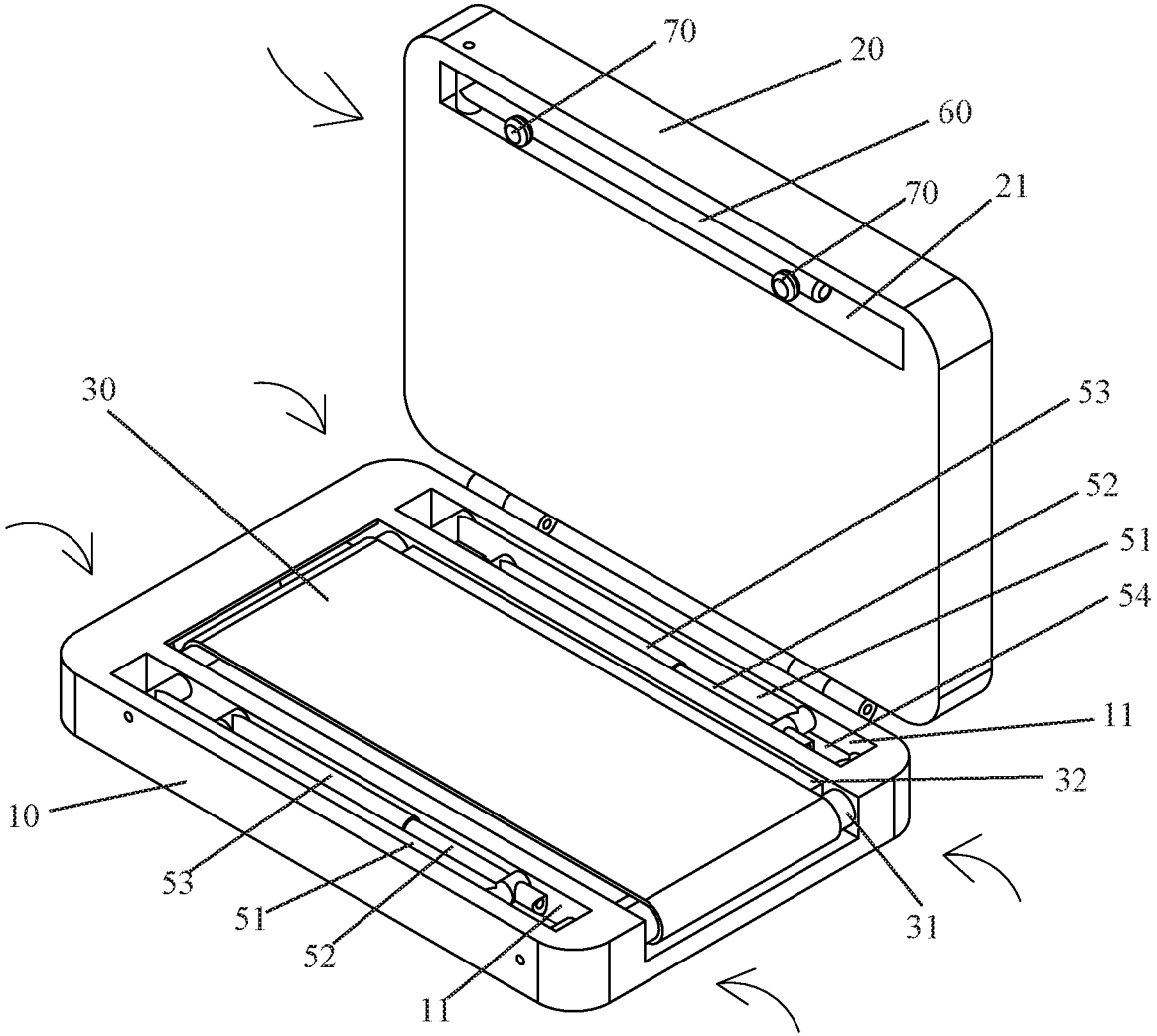
FIG. 9 is a perspective view showing a fully folded state of the foldable treadmill in accordance with the second preferred embodiment of the present invention.

Referring to FIGS. 6-9, the foldable treadmill further comprises two support posts 54 mounted on the working base 10. The two support posts 54 are removably received in the two first receiving grooves 11 of the working base 10 respectively. Each of the two support posts 54 is pivotally connected with the working base 10. Each of the two support posts 54 is movable relative to the working base 10 between a first position as shown in FIG. 8 where each of the two support posts 54 is folded into and fully received in one of the two first receiving grooves 11 of the working base 10 and a second position as shown in FIG. 6 where each of the two support posts 54 is expanded outward from one of the two first receiving grooves 11 of the working base 10 and is perpendicular to the working base 10. Each of the two handle units 50 further includes a second handle 53 telescopically mounted on the first handle 52. The second handle 53 of each of the two handle units 50 is connected with one of the two support posts 54 by the fastener member 70. The fastener member 70 extends through each of the two support posts 54 and is screwed into the second handle 53 of each of the two handle units 50.

In operation, after the cover 20 is pivoted upward to open the working base 10, the front support rack 60 is moved outward relative to the working base 10 and is expanded outward from the second receiving groove 21 of the cover 20 until the front support rack 60 is perpendicular to the cover 20. Then, each of the two handle units 50 is pivoted and moved upward relative to the working base 10 such that the upright 51 and the first handle 52 are expanded outward from one of the two first receiving grooves 11 of the working base 10 until the upright 51 is disposed at a vertical state. Then, the first handle 52 is pivoted and moved upward relative to the upright 51 until the first handle 52 is perpendicular to the upright 51. Then, the fastener member 70 extends through the front support rack 60 and is screwed into the first handle 52 of each of the two handle units 50. Thus, the first handle 52 of each of the two handle units 50 and the front support rack 60 are secured by the fastener member 70. Then, each of the two support posts 54 is pivoted upward relative to the working base 10 and is expanded outward from one of the two first receiving grooves 11 of the working base 10 until each of the two support posts 54 is disposed at a vertical state. Then, the second handle 53 of each of the two handle units 50 is pulled outward relative to the first handle 52 and is moved to abut one of the two support posts 54. Then, the fastener member 70 extends through each of the two support posts 54 and is screwed into the second handle 53 of each of the two handle units 50 such that each of the two support posts 54 and the second handle 53 of each of the two handle units 50 are secured by the fastener member 70. In such a manner, when the user is walking or running on the walking belt 30, the front support rack 60 or the first handle 52 of each of the two handle units 50 or the second handle 53 of each of the two handle units 50 is used to support the user's hands.

Accordingly, the foldable treadmill is assembled quickly after the cover 20 is pivoted upward to open the working base 10, such that the foldable treadmill is assembled and operated easily and conveniently. In addition, the foldable treadmill is collapsed and stored easily and occupies a small space when not in use, thereby facilitating packaging, storage and transportation of the foldable treadmill. Further, the cover 20 covers the working base 10 when the foldable treadmill is not in use to provide a dustproof and storage effect. Further, when the foldable treadmill is folded, the foldable treadmill functions as a piece of furniture, such as a cabinet, chair, bed or the like, thereby enhancing the versatility of the foldable treadmill and the aesthetic quality of the house.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A foldable treadmill comprising:

a working base;

a cover pivotally connected with the working base;

a walking belt mounted on the working base;

at least two rollers arranged in the walking belt;

a support board arranged in the walking belt;

two handle units mounted on the working base; and a front support rack mounted on the cover;

wherein:

the working base is a platform placed on a plane;

the working base has a top provided with two first receiving grooves;

the cover has a side pivotally connected with a side of the working base;

the cover is pivotable relative to the working base to open or cover the top of the working base;

the cover has an inner face provided with a second receiving groove;

the walking belt is rotatably mounted on the working base;

the two handle units are removably received in the two first receiving grooves of the working base respectively;

each of the two handle units is connected with the front support rack by a fastener member;

each of the two handle units includes an upright pivotally connected with the working base, and a first handle pivotally connected with the upright;

each of the two handle units is movable relative to the working base;

each of the first handles is movable relative to the respective upright;

the front support rack is pivotally connected with the cover and received in the second receiving groove of the cover; and the front support rack is movable relative to the working base.

2. The foldable treadmill as claimed in claim 1, wherein the front support rack is provided with an electronic instrument.

3. The foldable treadmill as claimed in claim 1, further comprising:

a drive motor mounted on the working base;

wherein the drive motor drives and rotates the at least two rollers which drives and rotates the walking belt.

4. A foldable treadmill comprising:

a working base;

a cover pivotally connected with the working base;

a walking belt mounted on the working base;

at least two rollers arranged in the walking belt;

a support board arranged in the walking belt;

two handle units mounted on the working base; and a front support rack mounted on the cover;

wherein:

the working base is a platform placed on a plane;

the working base has a top provided with two first receiving grooves;

the cover has a side pivotally connected with a side of the working base;

the cover is pivotable relative to the working base to open or cover the top of the working base;

the cover has an inner face provided with a second receiving groove;

the walking belt is rotatably mounted on the working base;

each of the two handle units includes an upright pivotally connected with the working base, and a first handle pivotally connected with the upright;

each of the two handle units is movable relative to the working base;

each of the first handles is movable relative to the respective upright;

the front support rack is pivotally connected with the cover and received in the second receiving groove of the cover;

the front support rack is movable relative to the working base; and two support posts mounted on the working base;

wherein:

the two support posts and each of the two handle units are removably received in the two first receiving grooves of the working base respectively;

each of the two support posts is pivotally connected with the working base;

each of the two support posts is movable relative to the working base;

each of the two handle units further includes a second handle telescopically mounted on the first handle; and the second handle of each of the two handle units is connected with one of the two support posts by a fastener member.

* * * * *